US006398498B1

(12) United States Patent
Boyesen

(10) Patent No.: US 6,398,498 B1
(45) Date of Patent: Jun. 4, 2002

(54) IMPELLER FOR WATER PUMPS

(76) Inventor: Eyvind Boyesen, R.D. 2, Box 246A, Kempton, PA (US) 19529

( * ) Notice: Subject to any disclaimer, the term of this patent is extended or adjusted under 35 U.S.C. 154(b) by 0 days.

(21) Appl. No.: 09/415,489

(22) Filed: Oct. 12, 1999

(51) Int. Cl.[7] ..... F04D 29/38
(52) U.S. Cl. ..... 416/188; 416/243; 416/223 B
(58) Field of Search ..... 416/185, 188, 416/242, 243, 223 A, 223 B

(56) References Cited

U.S. PATENT DOCUMENTS 2,037,880 A * 4/1936 Charavay ..... 416/188
2,418,012 A * 3/1947 Chester ..... 416/188
2,484,554 A * 10/1949 Concordia et al. ..... 416/188
4,227,855 A * 10/1980 Flynn et al. ..... 415/215

* cited by examiner

*Primary Examiner*—Edward K. Look
*Assistant Examiner*—Ninh Nguyen

(57) ABSTRACT

There is disclosed herein an impeller for a centrifugal pump such as water pumps for automotive internal combustion engines or a centrifugal pump for liquids other than water. The impeller has a circular base and a series of similar vanes extending vertically from the base. Each vane extends rearwardly from its inner end to its outer end with respect to the direction of rotation of the rotor and is wider at its midpoint than its ends. The leading edge of each vane is concave at least at its inner end while the trailing edge of each vane is convex.

4 Claims, 5 Drawing Sheets

| WATER IMPELLER AND COVER COMPARISON | | | | | | |
|---|---|---|---|---|---|---|
| RPM | STOCK 98 YZ250 COVER STOCK IMPELLER | | | BOYESEN COVER BOYESEN IMPELLER | | |
| | | | | | | |
| 4000 | | 8.7 | | | 12.5 | |
| | | | | | | |
| 6000 | | 22.7 | | | 34.1 | |
| | | | | | | |
| 8000 | | 39.7 | | | 56 | |
| | | | | | | |
| 10000 | | 45.4 | | | 75.7 | |
| | | | | | | |
| MAX | 11600RPM | 46 | | 10300RPM | 79.5 | |
| | | *LITERS PER MINUTE | | | | |

Test Date: 2/16/99

*Boyesen Engineering*

Tested By: G.S.R.

Fig. 4

IMPELLER FOR WATER PUMPS

FIELD OF THE INVENTION

The present invention relates to a novel impeller design for water pumps, and particularly centrifugal water pumps for circulating cooling water through internal combustion engines, primarily internal combustion engines for use in motor vehicles. The impeller of course can be utilized in pumps for other purposes and for liquids other than water.

BACKGROUND OF THE INVENTION

Water pumps designed to provide cooling water to internal combustion engines conventionally have a casing containing a pumping chamber, a driven impeller to pump water by centrifugal force, an inlet aligned axially with the impeller and an outlet whose initial channel is tangent to the impeller vanes. The vanes of the impellers have uniformly been of a constant thickness, arcuate in shape and tangent to a circle drawn about the axis if the impeller. The vanes slope backwardly from their inner end to their outer end and force the water to the outlet.

While existing water pumps are effective, they do exert a parasite drag, decreasing the pump efficiency. In addition, they can require as much as three to five horse power to pump the required cooling water. Most important though is the fact that the more water pumped, the cooler the engine will run and the cooler the engine, the more horse power it will produce. However, the pump must be a reasonable size and weight because of space limitations.

With the foregoing in mind, a principal object of the present invention is to provide a novel impeller for water pumps which is effective in pumping water and has less parasitic drag thus requiring less power for driving the pump.

Another object of the present invention is to provide a novel impeller for a centrifugal pump, such as a water pump for a motor vehicle which, for the same or less power requirement as a conventional similar size pump will pump a greater quantity of water, permitting the engine to run cooler and therefore generate more useful power.

These and other objects of the present invention and the various features and details thereof will be apparent from the following description.

SUMMARY OF THE INVENTION

This invention includes a novel impeller for centrifugal water pumps or the like such as those used with internal combustion engines. The impeller comprises a circular base having a generally flat rear surface and an upwardly tapered forward end, A series of vanes project upwardly from the base, each vane having an inner end and an outer end. The vanes slope rearwardly with respect to the direction of rotation of the impeller and have a leading edge which is at least partially concave and a convex trailing edge.

BRIEF DESCRIPTION OF THE DRAWINGS

FIG. 4 is a chart showing a comparison of the output in liters per minute of water pumped by a stock impeller and the output of a similar size impeller of the present invention at varying revolutions per minute.

DETAILED DESCRIPTION OF THE PRESENT INVENTION

Figure 1:
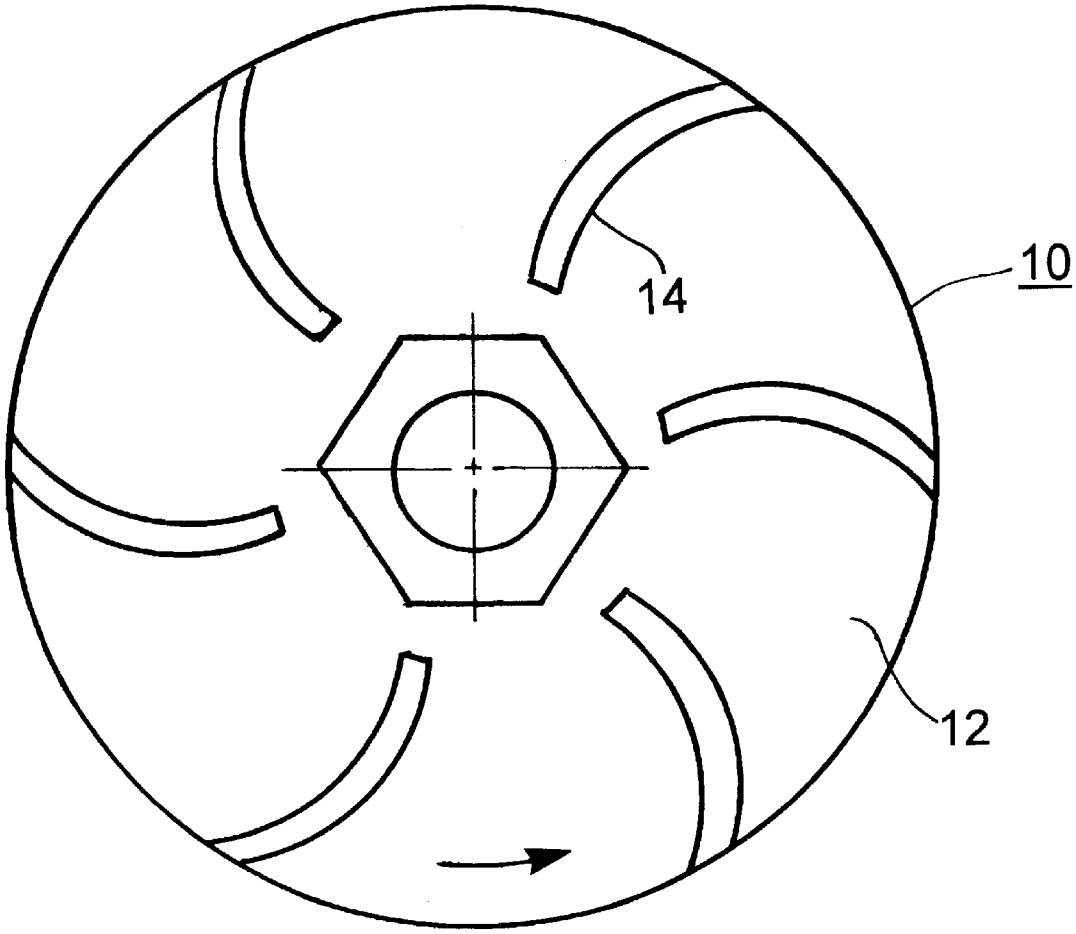
Fig. 1 (PRIOR ART)
FIG. 1 is an enlarged plan view of the conventional impeller for existing vehicle water pumps.

In FIG. 1 there is shown a conventional rotor for a water pump for an internal combustion engine of a motor vehicle or an other centrifugal pump for liquids. The rotor 10 includes a base plate 12 and a series of vanes 14 extending vertically upward from the base plate. As shown, each vane is of uniform thickness and arcuate in shape, with the arc for each vane tangent to an imaginary circle drawn about the axis of the rotor. The rotor rotates in the counterclockwise direction relative to FIG. 1.

Figure 2:
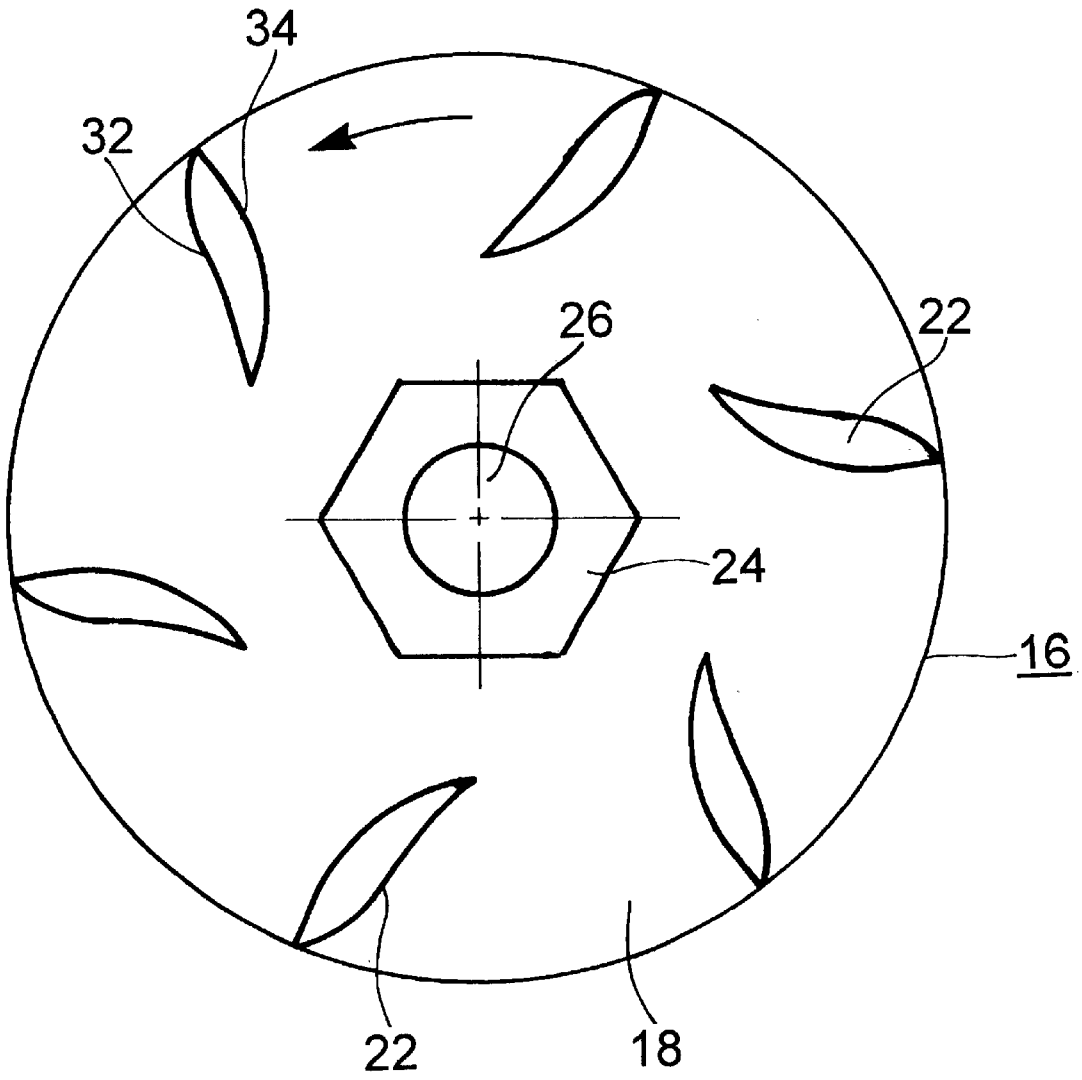
FIG. 2 is an enlarged plan view plan view of the impeller of the present invention.
Figure 3:
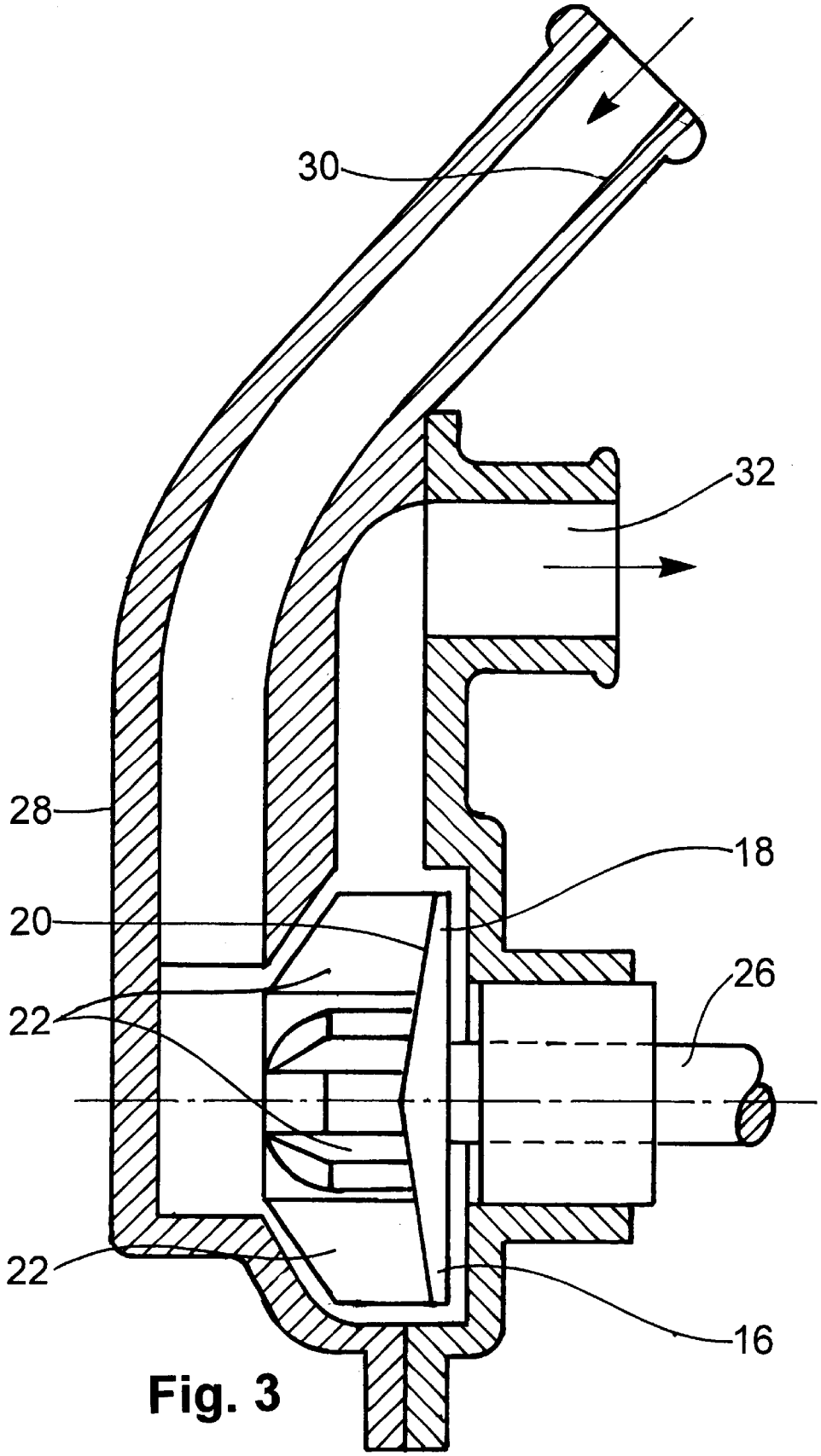
FIG. 3 is a longitudinal section view of a water pump incorporating the impeller of the present invention.

The rotor 16 of the present invention is illustrated in FIGS. 2 and 3 and comprises a base 18 having a slightly tapered outer surface 20 and a series of vanes 22 extending vertically upward from the base. The rotor has a central hub 24 mounted at the end of a drive shaft 26. Again, as in the prior art, the rotor is driven in the counterclockwise direction relative to FIG. 2. The rotor 16 is carried within the water pump housing 28 which has an water inlet passage 30 leading to the center of the rotor and an outlet passage 32 extending from the periphery of the rotor.

The novel portion of the present invention resides in the shape and positioning of the vanes 22. As illustrated in FIG. 2, all of the vanes 22 are of the same configuration. Each having a leading face 34 relative to the direction of rotation and a trailing face 36. The leading face of each vane is inclined rearwardly relative to the direction of rotation and serves to force the water outward by centrifugal force from the rotor to and through the outlet. The forward face of each vane meets the rear face at its inner end in a point and is slightly concave at its inner end and convex at its outer end. The rear face 34 is convex for its entire extent and at the periphery of the rotor joins the inner face in substantially a point. Thus, each vane 22 is wider at its midpoint than at either end and provides a streamlined shape passing through the pumped water. The effect of this shape is a greater amount of water pumped and a lesser amount of energy to pump the water.

Figure 5:
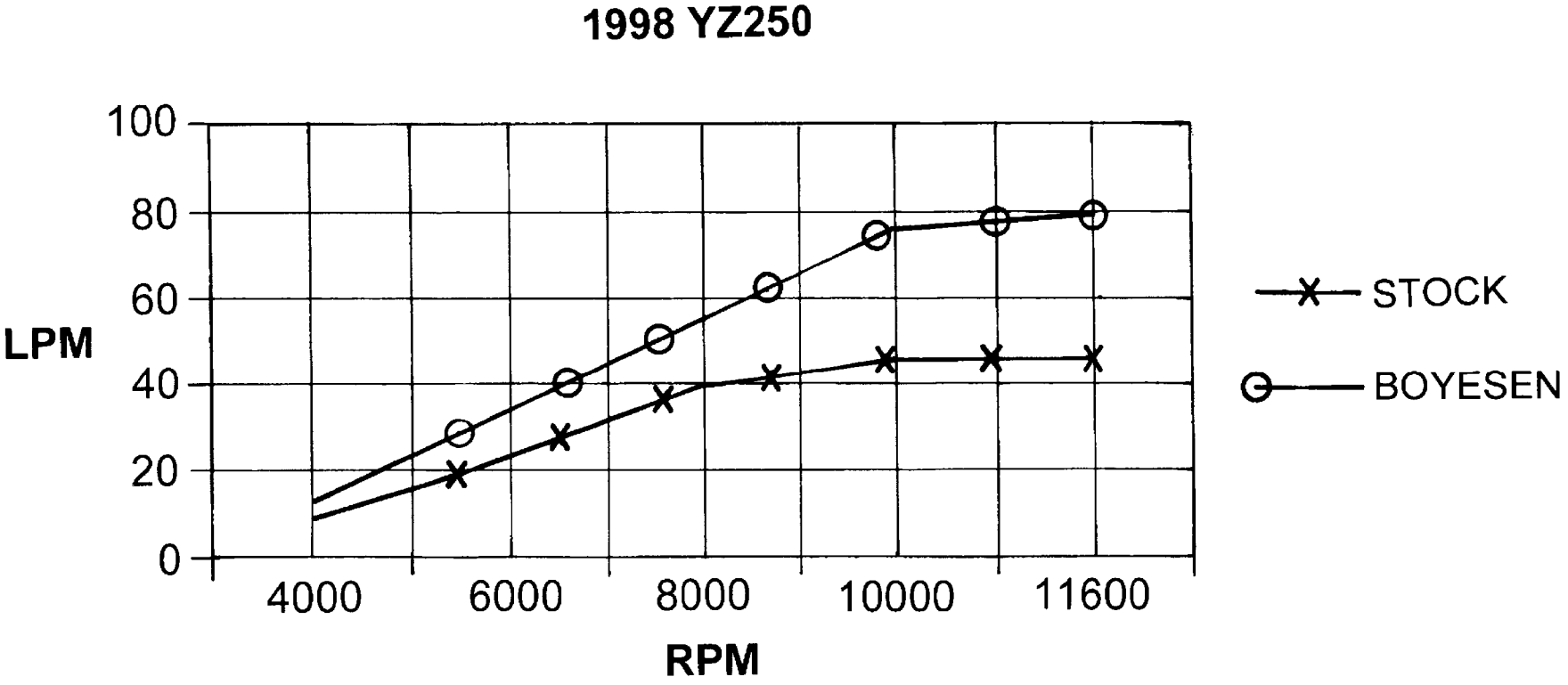
FIG. 5 is a graph of the test results of FIG. 4.

FIGS. 4 and 5 substantiate the above. They are a graph and chart showing the quantity of flow of cooling water through two water pumps for an internal combustion engine, each water pump being identical in size, at varying speeds. The chart of FIG. 4 was produced from a water pump for a 250 cc two cycle motorcycle engine and a similar sized water pump incorporating the impeller of the present invention. Both pumps were driven by an electric motor controlled by a rheostat. The rheostat settings are not listed, but at all speeds, the rheostat setting to maintain the speed was less for the impeller of the present invention than for the conventional impeller. As shown by this chart, at low speeds there is approximately a 30 percent increase in pumping capacity and at maximum speed, in excess of 70 percent pumping capacity. The graph of FIG. 5 illustrates this increase in quantity of water pumped at increasing speeds by the impeller of the present invention as compared to a conventional impeller. As set forth previously, at each speed setting, the rheostat to operate the motor was at a lower setting for the impeller of the present invention than that of the rheostat setting for the conventional impeller, clearly indicating less power to pump more cooling water.

Other engines were tested in addition to the above 250 cc motorcycle engine and showed increases in quantities of cooling water pumped at varying engine speeds with less power requirements.

While a particular embodiment of the present invention has been illustrated and described herein, it is not intended to limit the invention to such a disclosure and changes and modifications may be incorporated and embodied there within the scope of the accompanying claims.

I claim:

1. An impeller for a water pump comprising a circular base having a generally flat rear end and a conical upwardly tapered forward face terminating at an apex and adapted to rotate about an axis, a series of similar vanes on said impeller, each vane having a leading inner edge and a trailing outer edge with respect to the direction of rotation of said impeller, said vanes extending vertically upward relative to said base with both the inner and outer edges of the vanes extending above the apex of the forward face of the base, the inner edge of each vane tangent with an imaginary circle drawn about said axis and the outer edge of each vane terminating at the periphery of said base, each of said vanes being thicker at its midpoint than at its inner and outer edge, each vane having a leading face and a trailing face relative to the direction of rotation of the impeller with inner and outer portions thereof, the leading face having its inner portion thereof concave and its outer portion convex, the trailing face being convex.

2. An impeller for water pumps in accordance with claim 1 wherein the inner edge of each vane is in advance of the outer edge with respect to the direction of rotation of the impeller.

3. An impeller for water pumps in accordance with claim 1 wherein the leading and trailing edge of each impeller meet at a point at the inner edge of each vane.

4. An impeller for a water pump or the like in accordance with claim 3 wherein the leading face and trailing face of each vane meet at a point at the periphery of said rotor.

* * * * *